US010646011B2

(12) United States Patent
Wei et al.

(10) Patent No.: US 10,646,011 B2
(45) Date of Patent: May 12, 2020

(54) UMBRELLA RIB AND LIGHTING UMBRELLA

(71) Applicant: Zhejiang Yotrio Group Co., Ltd., Linhai (CN)

(72) Inventors: Weijie Wei, Linhai (CN); Jianqiang Xie, Linhai (CN)

(73) Assignee: Zhejiang Yotrio Group Co., LTD., Linhai (CN)

( * ) Notice: Subject to any disclaimer, the term of this patent is extended or adjusted under 35 U.S.C. 154(b) by 0 days.

(21) Appl. No.: 16/114,234

(22) Filed: Aug. 28, 2018

(65) Prior Publication Data

US 2019/0373991 A1 Dec. 12, 2019

(30) Foreign Application Priority Data

Jun. 12, 2018 (CN) ..... 2018 2 0909014 U

(51) Int. Cl.

| | |
|---|---|
| ***A45B 3/02*** | (2006.01) |
| ***A45B 25/02*** | (2006.01) |
| ***A45B 25/18*** | (2006.01) |
| *A45B 25/00* | (2006.01) |

(52) U.S. Cl.

CPC ..... *A45B 3/02* (2013.01); *A45B 25/02* (2013.01); *A45B 25/18* (2013.01); *A45B 2025/003* (2013.01); *A45B 2200/1018* (2013.01)

(58) Field of Classification Search

CPC ..... A45B 2200/1018

See application file for complete search history.

(56) References Cited

U.S. PATENT DOCUMENTS

| | | | | |
|---|---|---|---|---|
| 5,911,493 | A * | 6/1999 | Walker | A45B 3/04 135/16 |
| 6,089,727 | A * | 7/2000 | Wu | A45B 3/04 135/910 |
| 6,126,293 | A * | 10/2000 | Wu | A45B 3/04 135/910 |
| 6,439,249 | B1 * | 8/2002 | Pan | A45B 3/04 135/16 |
| 7,000,624 | B2 * | 2/2006 | Chang | A45B 3/04 135/16 |
| 9,265,312 | B2 * | 2/2016 | Chow | F21V 33/0004 |
| 9,408,444 | B2 * | 8/2016 | Jin | A45B 3/04 |
| 2006/0070642 | A1 * | 4/2006 | Lo | A45B 3/04 135/16 |

(Continued)

*Primary Examiner* — Noah Chandler Hawk

(74) *Attorney, Agent, or Firm* — Schwegman Lundberg & Woessner, P.A.

(57) ABSTRACT

This invention provides an umbrella rib and a light umbrella, wherein the umbrella rib includes a main body and a light emitting unit. The main body has a light groove, and the light emitting unit is detachably embedded inside the light groove for the convenience of replacement and maintenance. The light emitting unit can adopt a printed circuit board configured with a plurality of lighting lamps, or a light guide plate lighted by the lighting lamps. In addition, the first tube stopper and the second tube stopper are inserted into two ends of the light groove to ensure a sealing property of the umbrella rib. An umbrella frame and the light umbrella adopting the umbrella rib not only have a lighting function, but also provide a good lighting atmosphere, which provides convenience and fun for people's leisure life.

10 Claims, 6 Drawing Sheets

(56) References Cited

U.S. PATENT DOCUMENTS

| | | | | |
|---|---|---|---|---|
| 2008/0105287 | A1* | 5/2008 | Huali | A45B 3/04 135/16 |
| 2017/0122547 | A1* | 5/2017 | Luo | A45B 25/00 |
| 2018/0073719 | A1* | 3/2018 | Bliss | F21V 33/006 |

* cited by examiner

UMBRELLA RIB AND LIGHTING UMBRELLA

CROSS-REFERENCE TO RELATED APPLICATIONS

This Non-provisional application claims priority under 35 U.S.C. § 119(a) on Chinese Patent Application No(s). 201820909014.9 filed on Jun. 12, 2018, the entire contents of which are hereby incorporated by reference.

BACKGROUND OF THE INVENTION

Field of the Invention

This invention relates to an umbrella field and, more particularly, to an umbrella rib and a light umbrella.

Description of the Related Art

With continuous development of society, light umbrella, which has a function of sheltering the sun, providing light and shade, has been widely used in a home, a swimming pool, a hotel, a guesthouse, and other entertainment places. The light umbrella is a kind of umbrella with lighting function, which adds much convenience and fun to people's lives. For most of the existing light umbrellas, holes are drilled at corresponding positions of a long umbrella rib, and then LED lights and lampshades are tightened and fixed at the holes of the long umbrella rib. Another method is to drill holes at corresponding positions of two ends of short and long umbrella ribs, and then the LED lights are fixed at two ends of the umbrella ribs. The umbrella ribs are connected by a light guide bar to achieve light guiding, and a plurality of LED lights are electrically connected with each other in series to light surroundings. Although the above-mentioned product can achieve lighting, but the structure is complex and cannot be disassembled. Installation and maintenance is inconvenient, which needs to be improved.

BRIEF SUMMARY OF THE INVENTION

The objective of this invention is to provide an umbrella rib and a light umbrella including the umbrella rib to solve problems in the existing light umbrella that the structure is complex and cannot be disassembled, and the installation and maintenance is inconvenient.

To solve the above-mentioned problems, this invention provides an umbrella rib, and the umbrella rib includes a main body and a light emitting unit. The main body has a light groove, and the light emitting unit is detachably embedded inside the light groove.

According to one embodiment of this invention, the light emitting unit may further include a light emitting member and a transparent member. The light emitting member may be located inside the light groove, and the transparent member may be embedded inside the light groove. The transparent member may be a hollow tube, the light emitting member may be located inside the transparent member, and light emitted out by the light emitting member may transmit through the transparent member.

According to one embodiment of this invention, bending parts bending toward an interior of the light groove may be arranged at two edges of an opening of the light groove, respectively. Outer walls at two sides of the transparent member may have a first protruding rib, respectively, and the two first protruding ribs may be engaged by the bending parts of the main body, respectively, thus to prevent the transparent member from escaping from the light groove; and inner walls at two sides of the transparent member may have a second protruding rib, respectively, and the two second protruding ribs may engage two edges of the light emitting member.

According to one embodiment of this invention, the umbrella rib may further include a first tube stopper and a first plug. The first tube stopper may be inserted into one end of the transparent member, a channel may be disposed inside the first tube stopper, and one end of the first plug may pass through the channel of the first tube stopper and be electrically connected with the light emitting member.

According to one embodiment of this invention, the first tube stopper may include a tube stopper body and a fastening member. The tube stopper body may be arc shaped, the fastening member may be rotatably fastened at one side of the tube stopper body or expand from one side of the tube stopper body, and a protruding platform may be disposed at one side of the fastening member. When the fastening member is fastened at one side of the tube stopper body, the channel of the first tube stopper may be formed between the tube stopper body and the fastening member, and the protruding platform may be located in the channel of the first tube stopper and abut against a wire of the first plug, such that the first plug is fixed and unmoved.

According to one embodiment of this invention, the umbrella rib may further include a second tube stopper, and the second tube stopper may be inserted into the other end of the transparent member. A protrusion may be disposed at one side of the second tube stopper, one end of the light emitting member may have a connection hole, and the protrusion of the second tube stopper may be embedded inside the connection hole of the light emitting member.

According to one embodiment of this invention, the light emitting unit may include a light emitting member and a transparent member. The light emitting member may be located inside the light groove, and bending parts bending toward an interior of the light groove may be arranged at two edges of an opening of the light groove, respectively. Inner walls at two sides of the light groove may have a third protruding rib, respectively. The transparent member is sheet shaped. Two ends of the transparent member may be engaged between the bending part and the third protruding rib, respectively, and light emitted out by the light emitting member may transmit through the transparent member.

According to one embodiment of this invention, a bottom of the light groove may further have two symmetrically spaced-apart engaging parts, and the light emitting member may be engaged between the two engaging parts.

According to one embodiment of this invention, the light emitting unit may include a light guide plate and a light emitting member, and the light guide plate may be illuminated when the luminescent piece is lighting.

According to another aspect of this invention, this invention further provide a light umbrella. The light umbrella includes a main rod, a group of main umbrella ribs, a group of branch umbrella ribs, and umbrella cloth. One end of each main umbrella rib is connected with the main rod. One end of each branch umbrella rib is correspondingly connected with the main umbrella rib, respectively, the other end of each branch umbrella rib is connected with the main rod, and at least one of the main umbrella ribs and/or the branch umbrella ribs adopts the umbrella rib according to any of the above. The umbrella cloth is fixed at and covers the main umbrella ribs.

Compared with the prior art, this technical solution has the following advantages:

In this invention, by disposing the light groove at one side the main body of the umbrella rib, detachably embedding the light emitting unit inside the light groove, the umbrella rib can light through the light emitting unit. The light emitting unit is installed at the light groove as an independent part, and the light emitting unit can be disassembled and replaced. Compared with the traditional installation method of drilling holes, installation and maintenance in the solution of this invention is more convenient and simple.

In this invention, by disposing the transparent member as the hollow tube, and disposing the light emitting member inside the transparent member, the transparent member can not only plays a role of protecting the light emitting member, but also plays a role of transmitting the light. The light emitting member and the transparent member form a whole light emitting unit that can be separately manufactured and installed as an electronic semi-finished product, which is easy for manufacture.

This invention provides the first tube stopper to ensure the sealing property of the light emitting unit, and the first plug is disposed to connect the external power supply, so as to facilitate power supply to the light emitting unit.

This invention provides the second tube stopper to ensure the sealing property of the light emitting unit; and mutual engagement between the protrusion part of the second tube stopper and the connection hole of the light emitting member ensures stability of the light emitting member.

This invention adopts the above-mentioned umbrella rib with the light emitting unit in the main umbrella rib or the branch umbrella rib of the light umbrella, not only the light umbrella has the lighting function, but also a good lighting atmosphere is provided, which provides convenience and fun for people's leisure life.

DETAILED DESCRIPTION OF THE INVENTION

The following description is only used to expose this invention so that those skilled in the art can implement this invention. The following described embodiments are only examples, and those skilled in the art can think of other obvious modifications. The basic principle of this invention defined in the following description can be applied to other embodiments, variants, improvements, equivalents, and other solutions without departing from the spirit and scope of this invention.

Figure 1:
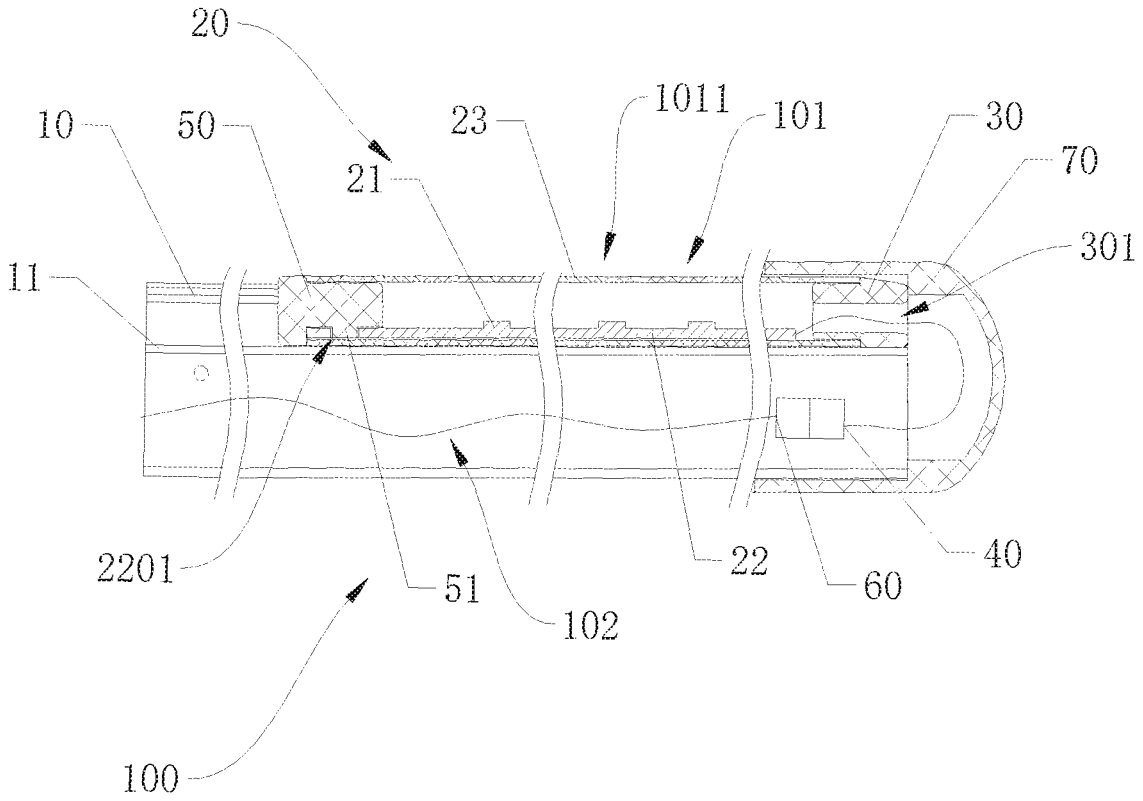
FIG. 1 is a sectional view of an umbrella rib according to the first embodiment of this invention.
Figure 2:
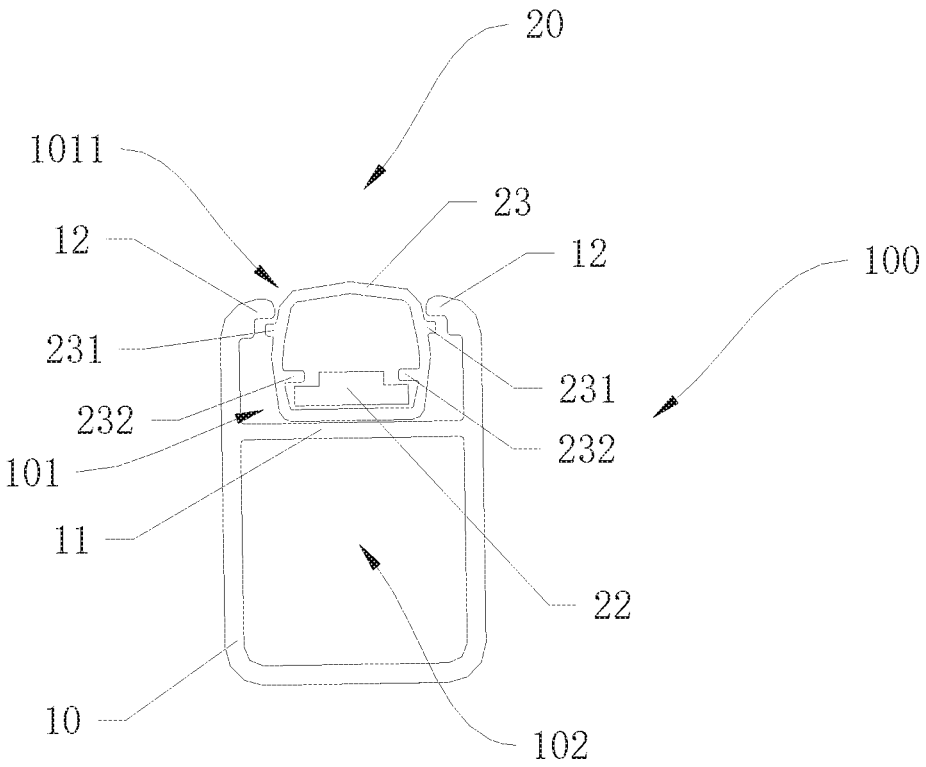
FIG. 2 is a side view of the umbrella rib according to the first embodiment of this invention.

This invention provides an umbrella rib 100 and, more particularly, an umbrella rib 100 with a lighting lamp. As shown in FIG. 1 and FIG. 2, the umbrella rib 100 described in the first embodiment includes a main body 10 and a light emitting unit 20.

The main body 10 is long-strip shaped, and the main body 10 has a light groove 101. The light groove 101 has an opening 1011. A channel 102 is disposed inside the main body 10, and the second channel 102 can be square, circular or other shaped. The light groove 101 and the channel 102 of the main body 10 are separated by a separation part 11. Bending parts 12 bending toward the interior of the light groove 101 are arranged at two edges of the opening of the light groove, respectively.

The light emitting unit 20 is detachably inserted inside the light groove 101 and provides a function of lighting.

Further, in the first embodiment, the light emitting unit 20 includes a light emitting member 22 and a transparent member 23. The light emitting member 22 is a printed circuit board, the light emitting member 22 has a plurality of lighting lamps 21 spaced apart, and a connection hole 2201 is disposed at one end of the light emitting member 22. However, the light emitting member 22 of this invention is not limited to the printed circuit board, for example, in other embodiments, the light emitting member 22 can be long-striped lights.

The transparent member 23 is a hollow tube, and the transparent member 23 is embedded inside the light groove 101. The light emitting member 22 is located inside the transparent member 23, and light emitted out by the light emitting member 22 transmits through the transparent member 23. In this way, the transparent member 23 not only plays a role of protecting the light emitting member 22, but also plays a role of transmitting the light. In addition, the light emitting member 22 and the transparent member 23 are integrated into a whole, and the light emitting unit 20 is installed at the light groove 101 as a separate part, which can be easily disassembled and replaced. When the light emitting unit 20 needs to be replaced or repaired, a user can directly disassemble the light emitting unit 20 for replacement or maintenance. The light emitting unit 20 can also be separately manufactured as an electronic semi-finished product.

As shown in FIG. 2, the transparent member 23 is a square tube, and outer walls at two sides of the transparent member 23 have a first protruding rib 231, respectively. The two first protruding ribs 231 are engaged by the bending parts 12 of the main body 10, respectively, thus to prevent the transparent member 23 from escaping from the light groove 101. Inner walls at two sides of the transparent member 23 have a second protruding rib 232, respectively, and the two second protruding ribs 232 engage two sides of the light emitting member 22.

The umbrella rib further includes a first tube stopper 30 and a first plug 40. As shown in FIG. 1, the first tube stopper 30 is inserted into one end of the transparent member 23, and a channel 301 is disposed inside the first tube stopper 30. One end of the first plug 40 passes through the channel 301 of the first tube stopper 30 and is electrically connected with the light emitting member 22. Optionally, the first tube stopper 30 is a rubber stopper, but this invention is not limited thereto. In other embodiments, the first tube stopper 30 can adopt other materials.

The umbrella rib further includes a second tube stopper 50, and the second tube stopper 50 is inserted into the other end of the transparent member 23. A protrusion 51 is disposed at one side of the second tube stopper 50, and the protrusion 51 is embedded inside the connection hole 2201 of the light emitting member 22 to increase firmness between the light emitting member 22 and the second tube stopper 50. In addition, the first tube stopper 30 and the second tube stopper 50 are respectively inserted into two ends of the transparent member 23, such that sealing and waterproof properties of the light emitting unit 20 of the umbrella rib 100 are ensured, which protects a circuit from being damaged.

In addition, in order to further increase sealing and waterproof properties of the umbrella rib, the first tube stopper 30 and the second tube stopper 50 are glued at two ends of the light transparent member 23, respectively. During a manufacturing process, glue can be coated at the first tube stopper 30, the second tube stopper 50, and the inner wall of the transparent member 23 in advance, and then the first tube stopper 30 and the second tube stopper 50 are inserted into two ends of the transparent member 23, respectively.

The umbrella rib 100 further includes a second plug 60, and one end of the second plug 60 passes through the second channel 102 of the main body 10 and is connected with the first plug 40. The second plug 60 is used for external power supply, for example, the second plug 60 can be connected with a rechargeable battery or a solar power generating coil.

The umbrella rib 100 further includes an umbrella rib sleeve head 70, and the umbrella rib sleeve head 70 is sleeved at the main body 10 and is located at the same end of the first tube stopper 30, thus to seal the end of the main body 10 and hide and protect the first plug 221 and the second plug 60.

Figure 3:
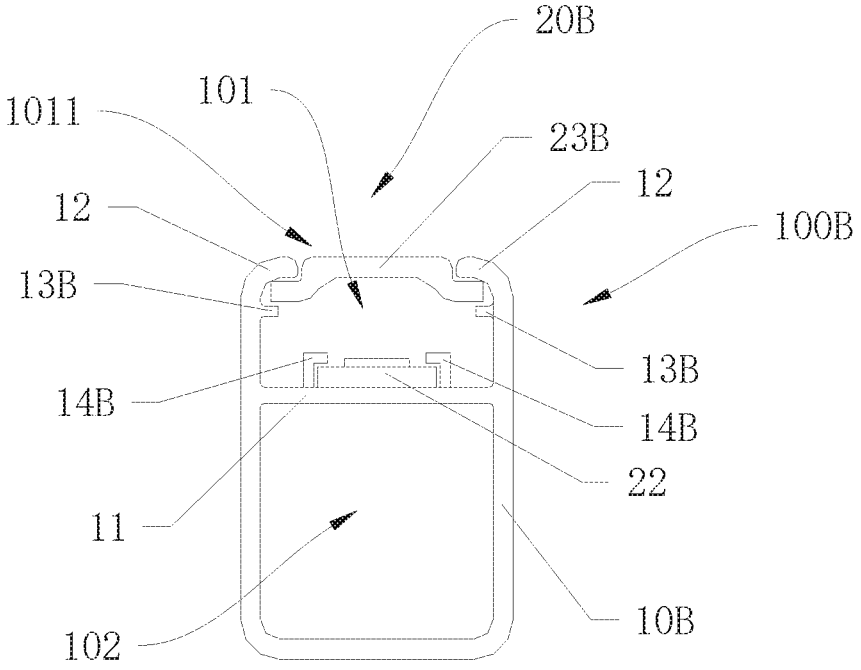
FIG. 3 is a side view of the umbrella rib according to the second embodiment of this invention.

As shown in FIG. 3, the structure of the umbrella rib 100B in the second embodiment is substantially the same with the structure of the umbrella rib 100 in the first embodiment, and the difference lies in the main body 10B and the light emitting unit 20B. Specifically, inner walls at two sides of the light groove 101 of the main body 10B have a third protruding rib 13B, respectively, the bottom of the light groove 101 further has two engaging parts 14B which are symmetrically spaced-apart, and the engaging parts 14B are inverted L shaped. The transparent member 23B of the light emitting unit 20B is sheet shaped, and two ends of the transparent member 23B are engaged between the bending parts 12 and the third protruding ribs 13B so as to cover the opening 1011 of the light groove 101. The light emitting member 22 is engaged between two engaging parts 14B, and light emitted out by the light emitting member 22 transmits through the transparent member 23B.

Figure 4:
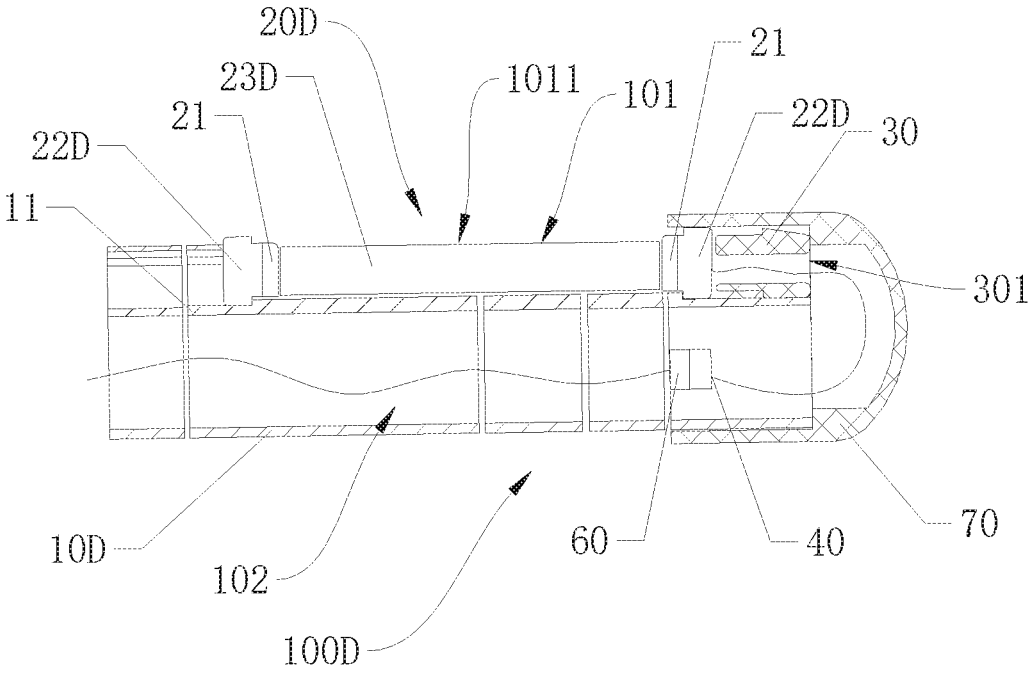
FIG. 4 is a sectional view of the umbrella rib according to the third embodiment of this invention.

As shown in FIG. 4, the structure of the umbrella rib 100D in the third embodiment is substantially the same with the structure of the umbrella rib 100 in the first embodiment, and the difference lies in light emitting unit 20D. The light emitting unit 20D further includes light emitting members 22D and a light guide plate 23D, and the light guide plate 23D is illuminated when the light emitting members 22D are lighting.

Specifically, in the third embodiment, the light emitting member 22D is a PCB lamp panel assembly with an lighting lamp 21. The number of the light emitting members 22D is two, and the two light emitting members 22D are located at two ends of the light groove 101, respectively. The light guide plate 23D is connected between the two light emitting members 22D, and the light guide plate 23D is illuminated when the light emitting members 22D are lighting. A wire of the first plug 40 passes through the channel 301 of the first tube stopper 30 and is connected with the PCB lamp panel assembly 22D of the light emitting unit 20D. Optionally, in the third embodiment, the surface of the light guide plate 23D has white molding powder. On one hand, the white molding powder protects the light guide plate 23D, on the other hand, the white molding powder can increase light transmittance of the light guide plate 23D. In order to ensure that the sealing and waterproof properties of the umbrella rib 100D and avoid damage to the circuits, outer surfaces of the two PCB lamp panel assemblies 22D are covered with heat shrink tubes. However, the number and the position of the light emitting members 22D are not limited in this invention. For example, in other embodiments, the light emitting member 22D is located at the bottom of the light guide plate 23D, and the light emitting member 22D and the light guide plate 23D are both embedded inside the light groove 101, i.e., the light emitting member 22D is placed at the bottom of the light groove 101.

Figure 5A:
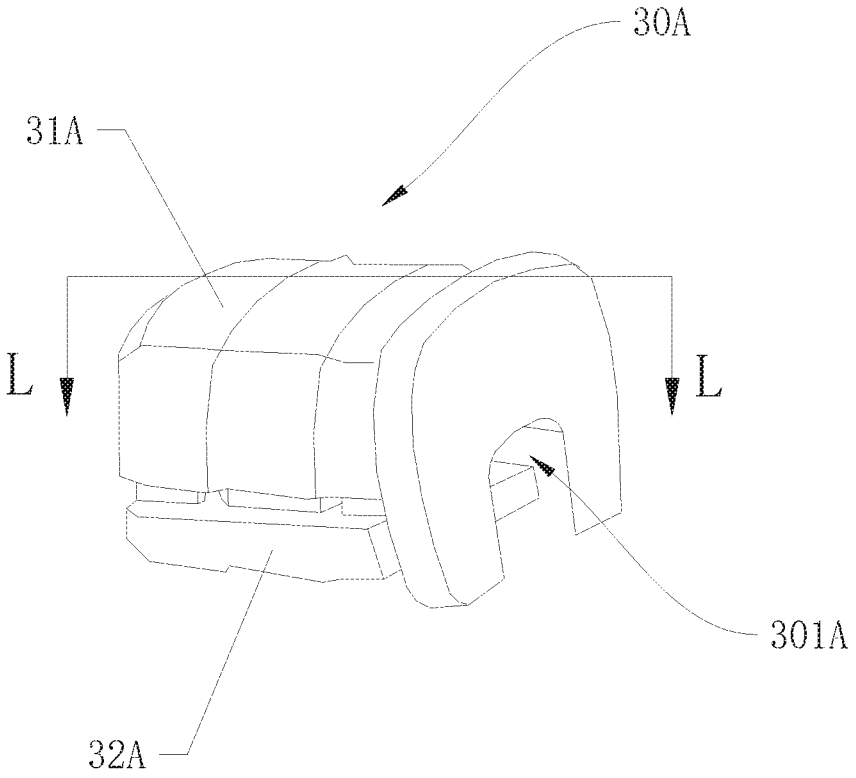
FIG. 5A is a three-dimensional schematic diagram of a first tube stopper of the umbrella rib according to another embodiment of this invention, wherein the first tube stopper is in a fastening state.
Figure 5B:
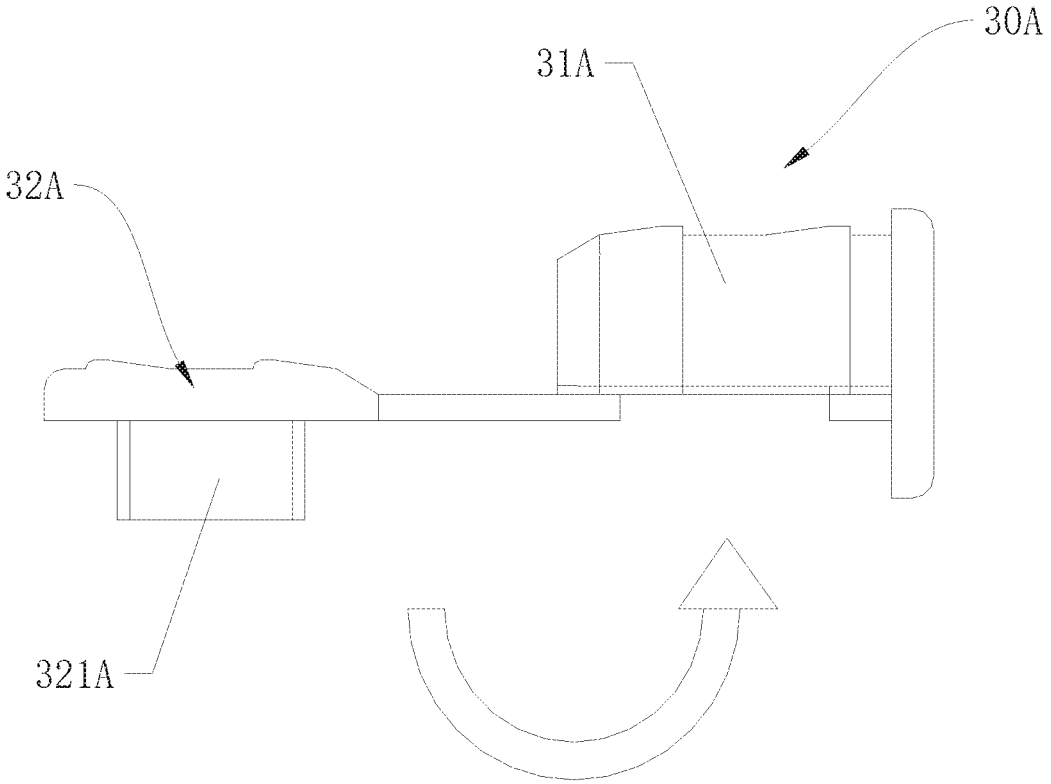
FIG. 5B is a schematic structural diagram of the first tube stopper in FIG. 5A in an unfolded state.
Figure 5C:
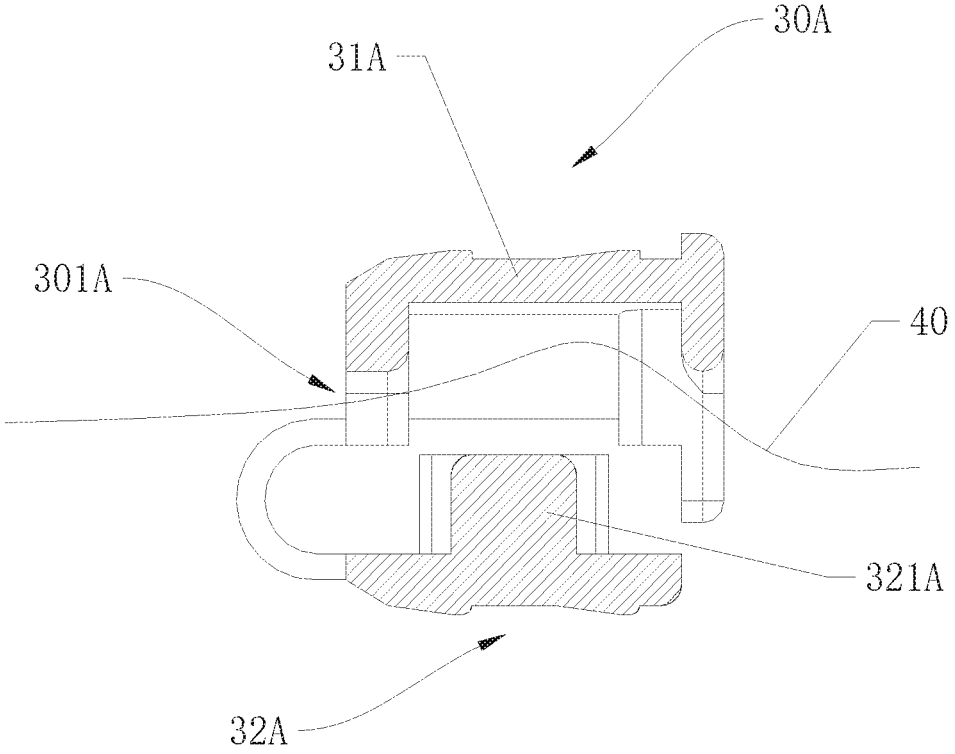
FIG. 5C is a sectional view of the first tube stopper in an L-L position in the fastening state of FIG. 5A.

As shown in FIG. 5A, FIG. 5B and FIG. 5C, in another embodiment of this invention, the first tube stopper 30A includes a tube stopper body 31A and a fastening member 32A. The tube stopper body 31A is arc shaped, and a protruding platform 321A is disposed at one side of the fastening member 32A. The first tube stopper 30A has two states. In the first state, the fastening member 32A is rotatably fastened at one side of the tube stopper body 31A, such that a channel 301A is formed between the tube stopper body 31A and the fastening member 32A. In the second state, the fastening member 32A expands from one side of the tube stopper body 31A. When the wire of the first plug 40 passes through the first tube stopper 30A, and the fastening member 32A is fastened at one side of the tube stopper body 31A, the protruding platform 321A is located in the channel 301A of the first tube stopper 30A and abuts against the wire of the first plug 40, such that the first plug 40 is fixed and unmoved. At this time, the whole first tube stopper 30A can be inserted into one end of the light groove 101 to play a role of sealing and waterproof. When the first tube stopper 30A is taken out from the light groove 101, and the fastening member 32A expands from one side of the tube stopper body 31A, the first plug 40 can move.

By disposing the protruding platform 321A of the fastening member 32A to abut against the wire of the first plug 40 passing through the channel 301A of the first tube stopper 30A, the wire of the first plug 40 cannot be moved axially. Advantages of this design are: the first plug 40 can be prevented from being cut off during operation due to dragging the first plug 40, or the first plug 40 and the printed circuit board 22 can be prevented from being separated, and the light emitting member 22 can also be prevented from moving by dragging the first plug 40.

Figure 6:
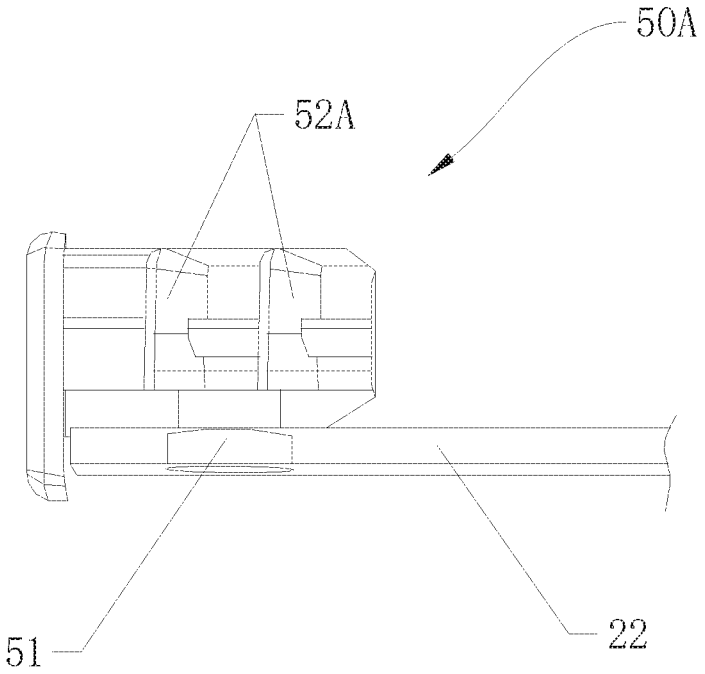
FIG. 6 is a schematic structural diagram of a second tube stopper of the umbrella rib according to another embodiment of this invention.

As shown in FIG. 6, in another embodiment of this invention, perimeters of the second tube stopper 50A has a plurality of protruding ribs 52A spaced apart, in this way, after the second tube stopper 50A is inserted into the other end of the light groove 101, protruding ribs 52A of the second tube stopper 50A abut against the inner wall of the transparent member 23 to increase firmness and tightness of the second tube stopper 50A. Both the first tube stopper 30A and the second tube stopper 50A can be applied to the umbrella rib 100 (100B, 100D) of any of the above-mentioned embodiments.

Figure 7:
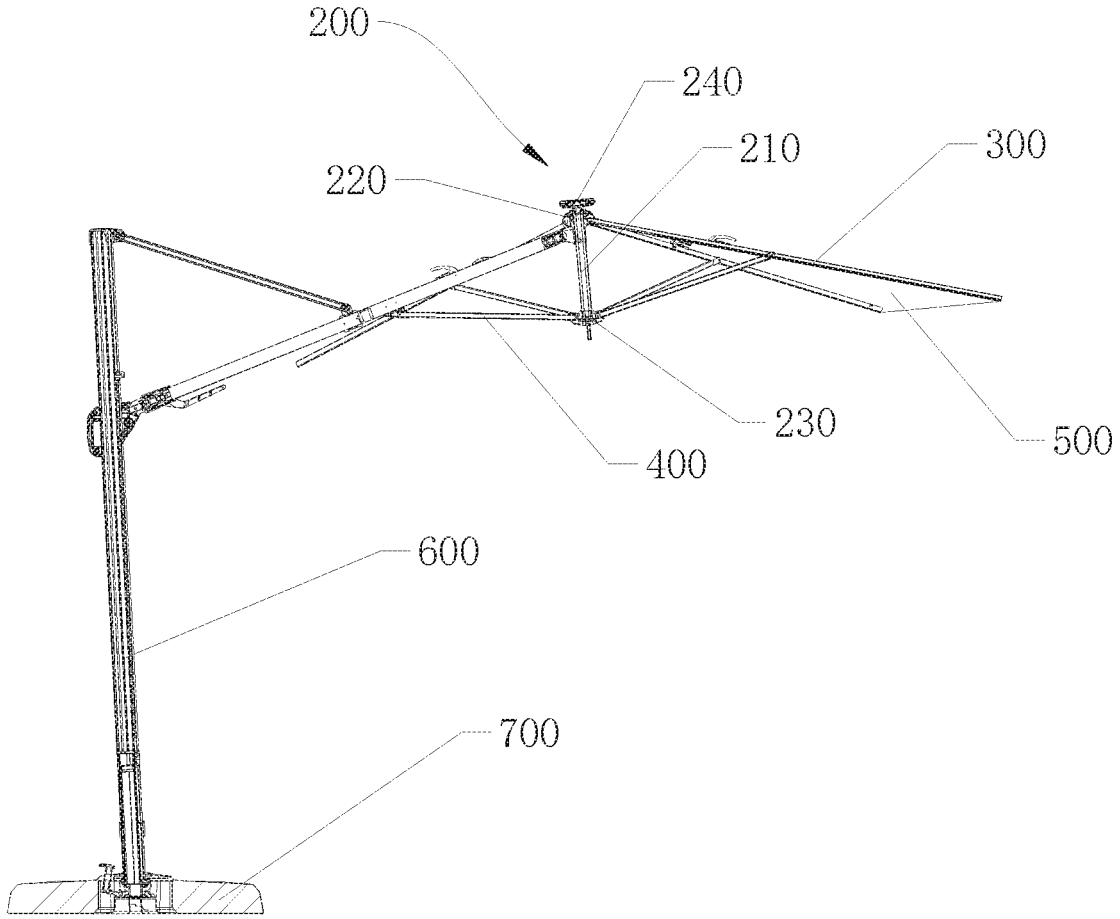
FIG. 7 is a schematic structural diagram of a light umbrella according to this invention.
Figure 8:
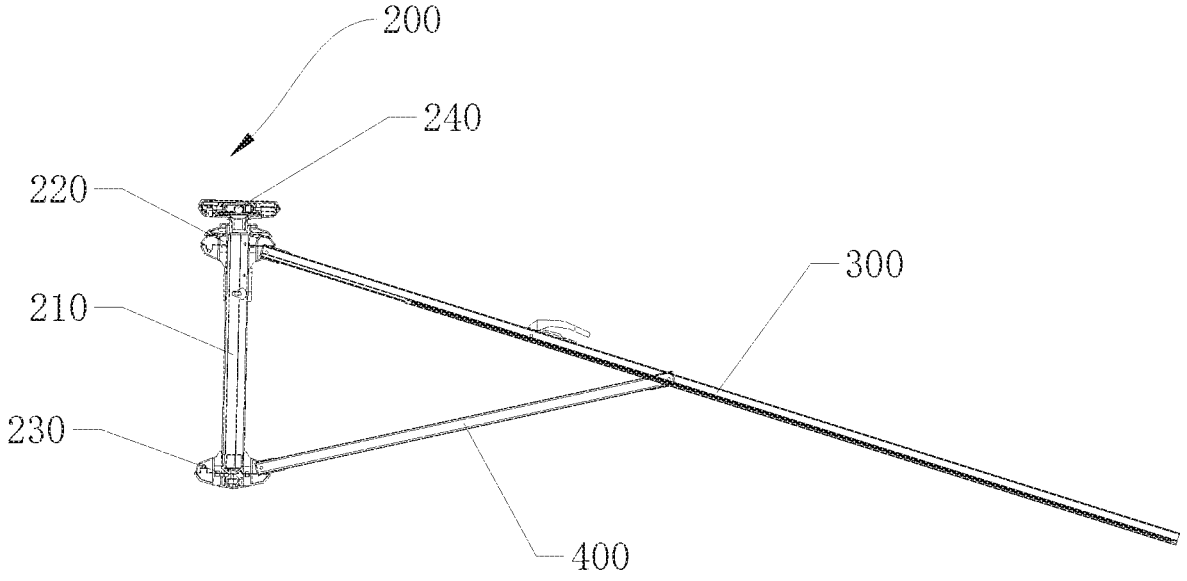
FIG. 8 is a partial sectional view of the light umbrella in FIG. 7, showing a connection way between the umbrella rib and a main rod.

As shown in FIG. 7 and FIG. 8, this invention further provides an umbrella frame, and the umbrella frame includes a main rod 200, a group of main umbrella ribs 300, and a group of branch umbrella ribs 400. The length of the main umbrella rib 300 is greater than the length of the branch umbrella rib 400, and at least one of the main umbrella ribs 300 and/or the branch umbrella ribs 400 adopts the umbrella rib 100 (100B, 100D) according to any of the above-mentioned embodiments. One end of each main umbrella rib 300 is connected with the main rod 200, one end of each branch umbrella rib 400 is correspondingly connected with the main umbrella rid 300, and the other end of each branch umbrella rib 400 is connected with the main rod 200.

As shown in FIG. 7 and FIG. 8, this invention further provides a light umbrella, and the light umbrella includes a main rod 200, a group of main umbrella ribs 300, a group of branch umbrella ribs 400, and umbrella cloth 500. At least one of the main umbrella ribs 300 and/or the branch umbrella ribs 400 adopts the umbrella rib 100 (100B, 100D) according to any of the above-mentioned embodiments. One end of each main umbrella rib 300 is connected with the main rod 200, one end of each branch umbrella rib 400 is correspondingly connected with the main umbrella rid 300, and the other end of each branch umbrella rib 400 is connected with the main rod 200. The umbrella cloth 500 is fixed at and covers the main umbrella rib 300.

In this embodiment, as shown in FIG. 7, the light umbrella is a solar outdoor light umbrella which further includes a support column 600 and a base 700. The main rod 200 includes a rod body 210, a first umbrella disc 220, a second umbrella disc 230, and a solar lamp disc 240. The first umbrella disc 220 is disposed at the top of the rod body 210, and the solar lamp disc 240 is disposed at the top of the first umbrella disc 220 and is electrically connected with the first umbrella disc 220. The second umbrella disc 230 is disposed at the bottom of the rod body 210. The first umbrella disc 220 and the second umbrella disc 230 are provided with coil circuit boards, and the solar lamp disc 240 receives sunlight to generate electricity. One end of each main umbrella rib 300 is fixed at the first umbrella disc 220 and is electrically connected with the first umbrella disc 220. One end of each branch umbrella rib 400 is correspondingly connected with the predetermined position of the main umbrella rib 300, and the other end of each branch umbrella rib 400 is fixed at the second umbrella disc 230 and is electrically connected with the second umbrella disc 230. One of the branch umbrella ribs 400 is electrically connected with the first umbrella disc 220 through a wire. The main umbrella ribs 300 and the branch umbrella ribs 400 extend radially around the main rod 200. The umbrella cloth 500 is fixed at and covers the main umbrella rib 300, the bottom of the support column 600 is erected and fixed at the base 700, and the top of the support column 600 is indirectly connected with the main rod 200.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. An umbrella rib comprising:

a main body, having a light groove;

a light emitting unit, detachably embedded inside the light groove, the light emitting unit comprising a light emitting member, located inside the light groove; and a transparent member, embedded inside the light groove, wherein the transparent member is a hollow tube, the light emitting member is located inside the transparent member, and light emitted out by the light emitting member transmits through the transparent member;

wherein bending parts bending toward an interior of the light groove are arranged at two edges of an opening of the light groove, respectively, outer walls at two sides of the transparent member have a first protruding rib, respectively, the two first protruding ribs are engaged by the bending parts of the main body, respectively, thus to prevent the transparent member from escaping from the light groove; and inner walls at two sides of the transparent member have a second protruding rib, respectively, and the two second protruding ribs engage two edges of the light emitting member.

2. The umbrella rib according to claim 1, wherein the umbrella rib further comprises a first tube stopper and a first plug, the first tube stopper is inserted into one end of the transparent member, a channel is provided inside the first tube stopper, and one end of the first plug passes through the channel of the first tube stopper and is electrically connected with the light emitting member.

3. A light umbrella comprising:

a main rod;

a group of main umbrella ribs, wherein one end of each main umbrella rib is connected with the main rod;

a group of branch umbrella ribs, wherein one end of each branch umbrella rib is correspondingly connected with the main umbrella rib, the other end of each branch umbrella rib is connected with the main rod, and at least one of the main umbrella ribs and/or the branch umbrella ribs adopts the umbrella rib as claimed in claim 2; and umbrella cloth, fixed at and covering the main umbrella ribs.

4. The umbrella rib according to claim 2, wherein the first tube stopper comprises a tube stopper body and a fastening member, the tube stopper body is arc shaped, the fastening member is rotatably fastened at one side of the tube stopper body or expands from one side of the tube stopper body, a protruding platform is provided at one side of the fastening member, when the fastening member is fastened at one side of the tube stopper body, the channel of the first tube stopper is formed between the tube stopper body and the fastening member, and the protruding platform is located in the channel of the first tube stopper and abuts against a wire of the first plug, such that the first plug is fixed and unmoved.

5. A light umbrella comprising:

a main rod;

a group of main umbrella ribs, wherein one end of each main umbrella rib is connected with the main rod;

a group of branch umbrella ribs, wherein one end of each branch umbrella rib is correspondingly connected with the main umbrella rib, the other end of each branch umbrella rib is connected with the main rod, and at least one of the main umbrella ribs and/or the branch umbrella ribs adopts the umbrella rib as claimed in claim 4; and umbrella cloth, fixed at and covering the main umbrella ribs.

6. The umbrella rib according to claim 2, wherein the umbrella rib further comprises a second tube stopper, the second tube stopper is inserted into the other end of the transparent member, a protrusion is provided at one side of the second tube stopper, one end of the light emitting member has a connection hole, and the protrusion of the second tube stopper is embedded inside the connection hole of the light emitting member.

7. A light umbrella comprising:

a main rod;

a group of main umbrella ribs, wherein one end of each main umbrella rib is connected with the main rod;

a group of branch umbrella ribs, wherein one end of each branch umbrella rib is correspondingly connected with the main umbrella rib, the other end of each branch umbrella rib is connected with the main rod, and at least one of the main umbrella ribs and/or the branch umbrella ribs adopts the umbrella rib as claimed in claim 6; and umbrella cloth, fixed at and covering the main umbrella ribs.

8. The umbrella rib according to claim 1, wherein the light emitting unit comprises a light guide plate and a light emitting member, and the light guide plate is illuminated when the light emitting member is lighting.

9. A light umbrella comprising:

a main rod;

a group of main umbrella ribs, wherein one end of each main umbrella rib is connected with the main rod;

a group of branch umbrella ribs, wherein one end of each branch umbrella rib is correspondingly connected with the main umbrella rib, the other end of each branch umbrella rib is connected with the main rod, and at least one of the main umbrella ribs and/or the branch umbrella ribs adopts the umbrella rib as claimed in claim 8; and umbrella cloth, fixed at and covering the main umbrella ribs.

10. A light umbrella comprising:

a main rod;

a group of main umbrella ribs, wherein one end of each main umbrella rib is connected with the main rod;

a group of branch umbrella ribs, wherein one end of each branch umbrella rib is correspondingly connected with the main umbrella rib, the other end of each branch umbrella rib is connected with the main rod, and at least one of the main umbrella ribs and/or the branch umbrella ribs adopts the umbrella rib as claimed in claim 1; and umbrella cloth, fixed at and covering the main umbrella ribs.

* * * * *